US009511364B2

(12) United States Patent
Andersin

(10) Patent No.: US 9,511,364 B2
(45) Date of Patent: Dec. 6, 2016

(54) MICROPLATE GUIDE FOR A PIPETTE

(71) Applicant: Sartorius Biohit Liquid Handling Oy, Helsinki (FI)

(72) Inventor: Kati Andersin, Porvoo (FI)

(73) Assignee: SARTORIUS BIOHIT LIQUID HANDLING OY, Helsinki (FI)

( * ) Notice: Subject to any disclaimer, the term of this patent is extended or adjusted under 35 U.S.C. 154(b) by 766 days.

(21) Appl. No.: 13/773,057

(22) Filed: Feb. 21, 2013

(65) Prior Publication Data

US 2013/0267038 A1 Oct. 10, 2013

(30) Foreign Application Priority Data

Feb. 21, 2012 (FI) ..... 20125199

(51) Int. Cl.
*B01L 3/02* (2006.01)

(52) U.S. Cl.
CPC ..... *B01L 3/021* (2013.01); *B01L 3/0237* (2013.01); *B01L 2200/143* (2013.01); *B01L 2300/027* (2013.01); *Y10T 436/2575* (2015.01)

(58) Field of Classification Search
CPC ... B01L 3/021; B01L 3/0237; B01L 2200/143; B01L 2200/14; B01L 2300/027; Y10T 436/2575
See application file for complete search history.

(56) References Cited

U.S. PATENT DOCUMENTS 6,090,348 A * 7/2000 Steele ..... B01L 3/0227 422/525
7,597,854 B1 10/2009 Reynolds
7,726,212 B2 6/2010 Magnussen et al.
2005/0102056 A1 5/2005 Du
2006/0188406 A1 8/2006 Frost, III
2007/0072168 A1 3/2007 Ryle
2009/0274587 A1 11/2009 Butz et al.
2011/0160909 A1 6/2011 Glauser et al.
2011/0195518 A1 8/2011 Gjerde et al.
2011/0268627 A1 11/2011 Warhurst et al.

FOREIGN PATENT DOCUMENTS

WO WO 2007/121324 A1 10/2007
WO WO 2011/032228 A1 3/2011

OTHER PUBLICATIONS

Search report issued in Finnish patent application 20125199 dated Nov. 23, 2012.
Extended European Search Report for European Application No. 13397503.7, dated Aug. 6, 2014.
Finnish Office Action for Finnish Application No. 20125199, dated Feb. 3, 2015.

* cited by examiner

*Primary Examiner* — Christopher A Hixson
(74) *Attorney, Agent, or Firm* — Birch, Stewart, Kolasch & Birch, LLP

(57) ABSTRACT

Microplate guide for a pipette, said guide comprising means for selecting the type of the microplate, the mode of dispensing and the dispensing direction, as well as means for indicating the next target for dispensing on the display of the pipette prior to each pipetting operation, and a method for guiding a pipetting operation, said method comprising the steps of selecting the type of microplate, selecting the mode of dispensing, and selecting the dispensing direction, followed by displaying on the display of the pipette the next target for dispensing prior to each pipetting operation.

3 Claims, 3 Drawing Sheets

8
5
Pipetting
50.0 µl
Tracker A 4
6
5
10...300 µl
4
300

MICROPLATE GUIDE FOR A PIPETTE

BACKGROUND

The microplate is one of the most widely used reaction vessels in, for instance, analytical research and clinical diagnostics. Its main dimensions are defined in the standards of the American National Standards Institute (ANSI), based on an initiative from 1996 of the Society for Biomolecular Sciences (SBS). The most commonly used microplates have 96 (8×12) and 384 (16×24) wells, reagents and samples being dispensed into these wells either by manual pipetting or using automatic liquid dispensers.

The location of the wells on the plate is indicated with a two-character code, the first character being a letter indicating the row and the second character being a digit indicating the column of the well. For instance for a plate with 96 wells, the location code of the well at the upper left corner is A1 while that of the lower right corner is H12.

Manual pipetting is either carried out with a single channel pipette or a multiple channel pipette with 8 or 12 channels, particularly developed for rapid filling of the plate. During manual pipetting, it may be difficult to observe the liquid if the amount to be dispensed is small, or the liquid is colourless. This fact makes it difficult for the person using the pipette to observe which well has already received a sample and which well should be the next to receive one.

At present, all solutions for aiding in pipetting to microplates are separate devices on which the microplate is placed (so-called microplate illuminators or microplate trackers), which devices emit light through the bottom of the microplate, thus indicating to the user the specific well which should next receive a pipetted sample. Once the sample is pipetted, the user either presses a button or a pedal on the apparatus, thus causing the beam of light to move to the next well to receive a pipetted sample. In addition to such electronic devices, there are also manually operated devices allowing the user to mark the well which is the target for next pipetting, using indicators such as pegs to be placed on the edges of the microplate. The problem in the use of both these systems is the obvious risk for mistakes. The user may accidentally press the button or move the peg to the wrong location, or forget to press the button or move the pegs. Moreover, the user must obtain a separate device which takes up space on the working table. These disadvantages may be eliminated by the guidance device of the invention.

SUMMARY OF THE INVENTION

The invention is directed to a microplate guide integrated in a pipette. The microplate guide is part of the operating interface of a manually held electronic pipette. The pipette may have either a single channel or multiple channels. The guiding function is shown on the display of the pipette and guides the user to select the desired target for pipetting on the microplate.

The type of microplate and the mode of dispensing are selected by means of the operating interface. As dispensing mode may be selected dispensing to individual wells on the microplate (single channel pipette) or in all wells in a row of wells on the microplate, either in vertical or horizontal order (pipette with multiple channels).

Once the mode of operation is selected and activated, the display of the pipette shows the user the next target for pipetting after each pipetting step. The location code of the next target for pipetting is then seen on the display. The indication system described above for the location of the wells on the microplate is utilized.

DETAILED DESCRIPTION OF THE INVENTION

Figure 1:
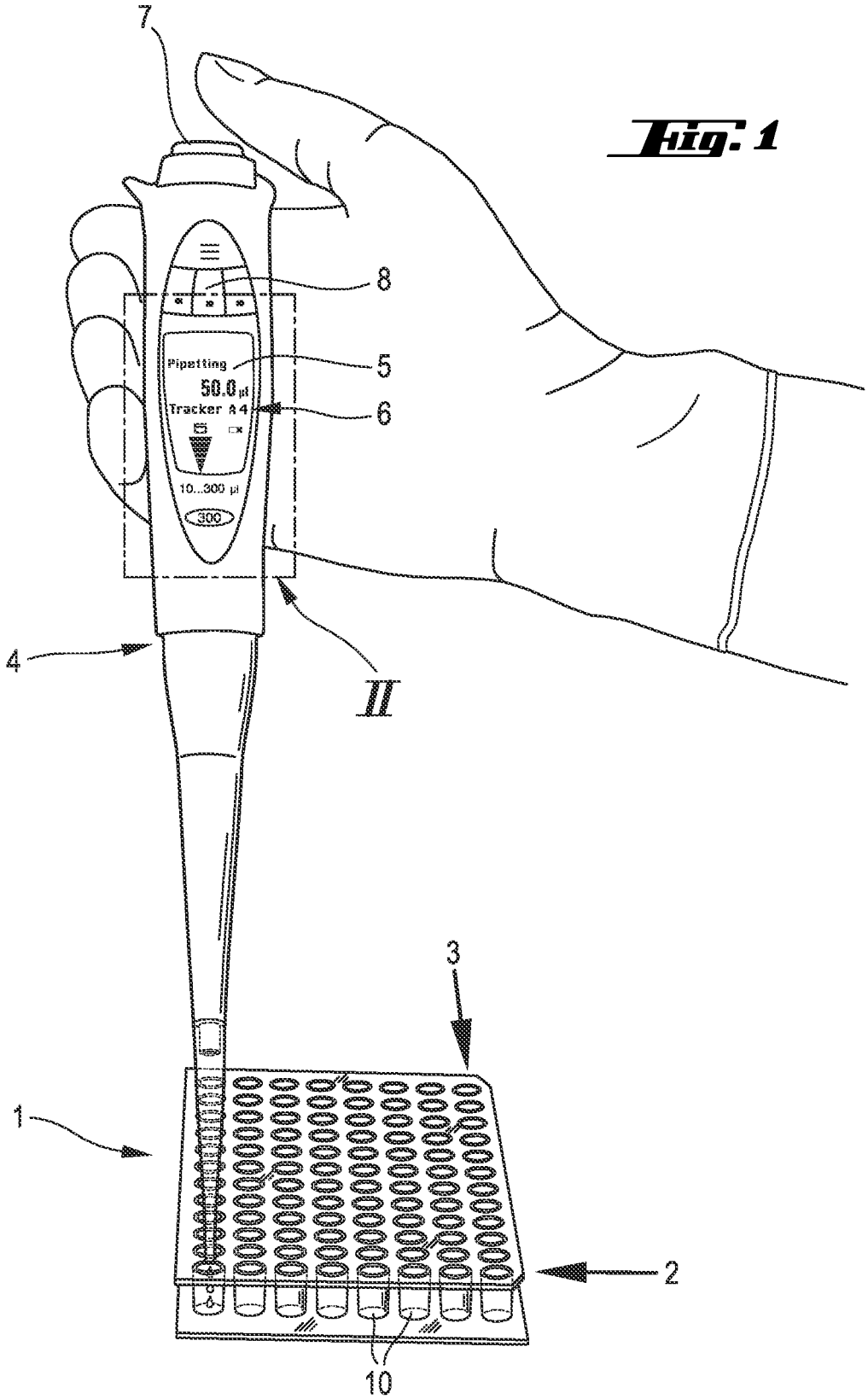
FIG. 1 shows an apparatus in use.

FIG. 1 shows an apparatus according to the invention in its application environment. On the edges of the microplate 1, containing wells 10 there are standard markings for rows 2 and columns 3. According to the invention, the location code 6 of the next target for pipetting is shown on the display 5 of the pipette 4, the code automatically incrementing following each dispensing triggered by means of actuating switch 7. The operation is programmed using the operating interface 8 of the pipette.

Figure 2:
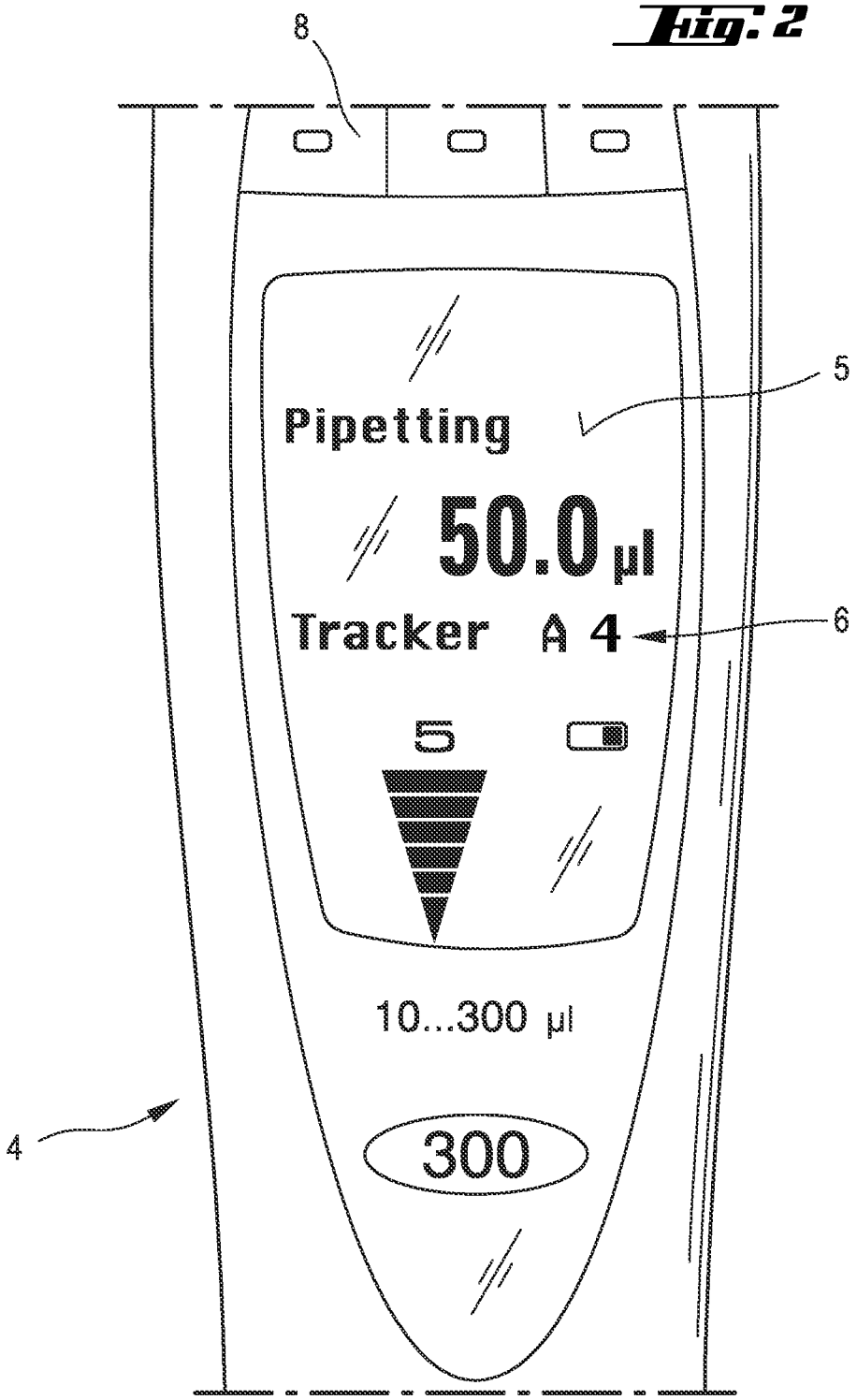
FIG. 2 is a detailed view of the pipette display in area II of FIG. 1.

In the case of a single channel pipette, the user first selects the desired type of microplate. Thereafter, serial pipetting either by rows or by columns is selected. Now the pipette is ready for use. During dispensing, the display shows the target well for pipetting, as seen in FIG. 2. If pipetting is carried out by rows, the next well is shown in the form: A1, A2, A3 . . . while for dispensing carried out by columns, the next target well for pipetting is indicated with codes A1, B1, C1 . . . etc.

In the case of a multichannel pipette, the user first selects the desired type of microplate. Thereafter, serial pipetting either by rows (a pipette with 12 channels) or by columns (a pipette with 8 channels) is selected.

When pipetting by rows, the next row of wells is indicated by the symbols A, B, C while for dispensing by columns, the next targeted column of wells is shown by the symbols 1, 2, 3 . . . etc.

Figure 3:
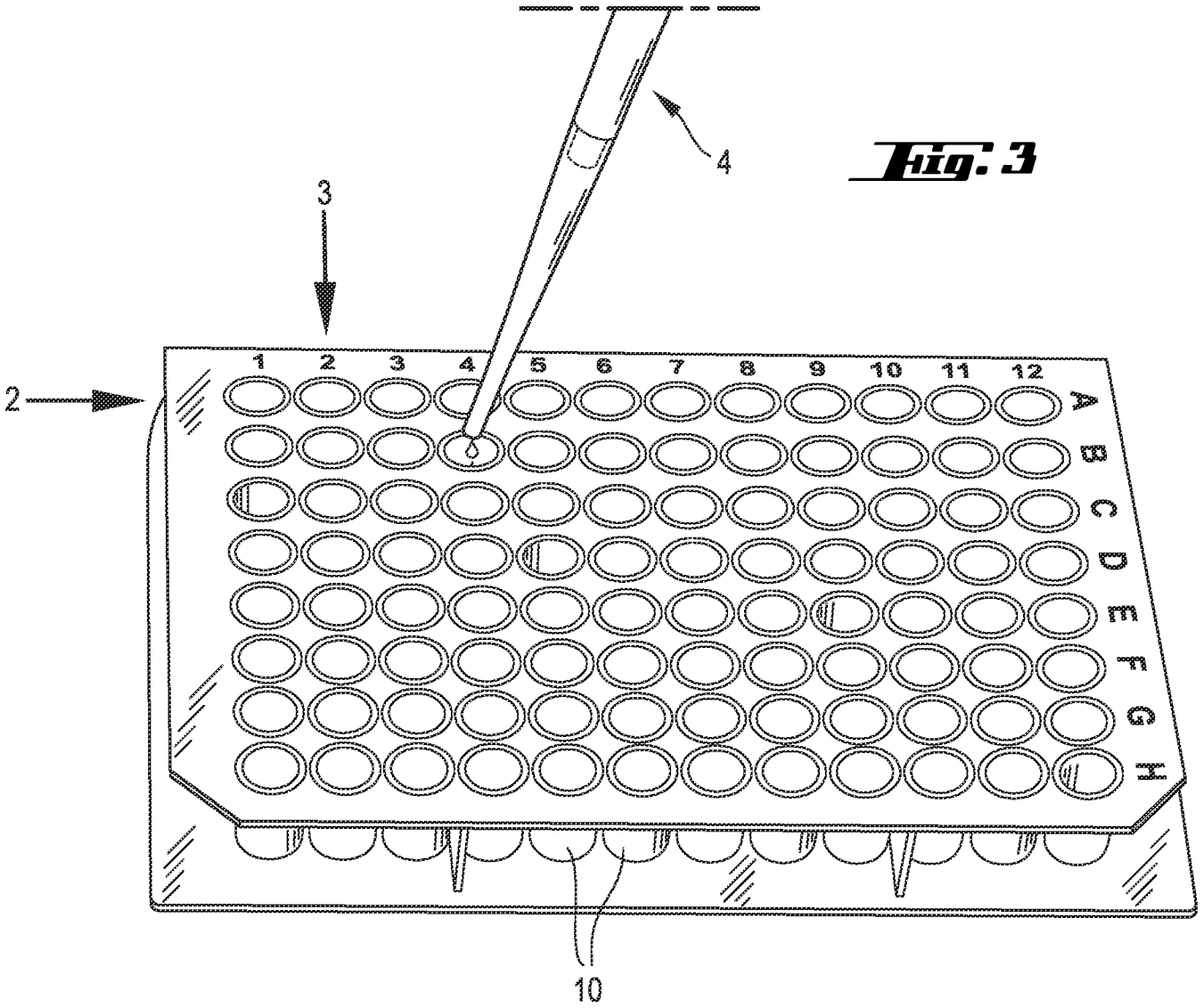
FIG. 3 depicts the pipette filling wells.

In the example described, the default situation for the pipette is that dispensing always starts at the first well, first row or first column. In one embodiment, prior to pipetting the user may instead of the first well or row select another starting point for pipetting, in which case the guiding device advances from this selected starting point as described earlier. In this embodiment, the user first selects the type of microplate to be used, the mode and direction of dispensing as well as the starting well for pipetting. Thereafter the pipette is ready for use, as seen in FIG. 3, showing the next target for pipetting after each pipetting operation. Alternatively, the user may also interrupt the serial dispensing at a desired location, and reprogram the coordinates of the next target well for pipetting, the guiding device thus continuing the guidance from the desired location.

According to an embodiment, it is also possible to decide whether to use all wells as targets for pipetting, and to determine which of the wells, e.g. the first six wells in each row, should receive samples. According to this embodiment, it is also possible to define the wells which should be left empty. Thus it is possible on determine that the six first wells in each row receive samples, the microplate guide thus automatically showing after the $6^{th}$ well in a row that dispensing shall be continued at the first well in the next row.

The invention claimed is:

1. A hand-held electronic pipette including a microplate guide comprising:

a hand-held electronic pipette with an adapter at the bottom for disposable pipette tips;

a screen display on one side of said hand-held electronic pipette where said screen display includes, at a minimum, whether pipetting is occurring, the volume of liquid being dispensed in each well, and the next target well;

at least one button located above and on the same side of said hand-held electronic pipette as said screen display; and a button on the top of said hand-held electronic pipette capable of being depressed by a user's thumb;

wherein the hand-held electronic pipette can be operated with one hand during pipetting and is configured to complete a pipetting action and automatically advance the target well displayed on said screen display when the top button is depressed by a user's thumb for a dispensing operation.

2. The hand-held electronic pipette according to claim 1, wherein the microplate guide is physically integrated into said hand-held electronic pipette to form an integral hand-held pipette secured to said microplate guide.

3. A method for guiding a pipetting operation using the hand-held electronic pipette including a microplate guide of claim 1, comprising the following steps:

selecting the type of microplate;

selecting the mode of dispensing; and selecting the dispensing direction;

followed by dispensing liquid into a target well through a pipette tip and automatically updating on the display the next target well for dispensing; and updating automatically the target well following each subsequent dispensing operation.

* * * * *